US007466275B2

(12) United States Patent
Cheng

(10) Patent No.: US 7,466,275 B2
(45) Date of Patent: Dec. 16, 2008

(54) ANTENNA MODULE FOR MOBILE PHONE

(75) Inventor: Keh-Chang Cheng, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 90 days.

(21) Appl. No.: 11/783,440

(22) Filed: Apr. 10, 2007

(65) Prior Publication Data

US 2008/0081658 A1 Apr. 3, 2008

(30) Foreign Application Priority Data

Oct. 2, 2006 (TW) ..... 95217636 U

(51) Int. Cl.
*H01Q 1/24* (2006.01)

(52) U.S. Cl. ..... 343/702

(58) Field of Classification Search ..... 343/702, 343/700 MS, 846, 841
See application file for complete search history.

(56) References Cited

U.S. PATENT DOCUMENTS 7,180,448 B2 * 2/2007 Suganthan et al. .... 343/700 MS
7,193,569 B2 * 3/2007 Vesterinen ..... 343/702
2006/0066490 A1 * 3/2006 Ku et al. ..... 343/702
2006/0290591 A1 * 12/2006 Nilsson et al. ..... 343/906
2007/0210969 A1 * 9/2007 Vance ..... 343/702

* cited by examiner

*Primary Examiner*—Hoang V Nguyen
(74) *Attorney, Agent, or Firm*—Rosenberg, Klein & Lee

(57) ABSTRACT

An antenna module of mobile phone has an antenna, a feed-in terminal and a grounding terminal. The antenna includes an antenna body for receiving and radiating electromagnetic waves, a feed-in portion and a grounding portion. The feed-in portion forms a first bump array with adhesive on a surface thereon. The grounding portion forms a second bump array with adhesive on a surface thereon. The first bump array and adhesive of the feed-in portion connect with the feed-in terminal, and the second bump array and adhesive of the grounding portion connect with the grounding terminal. The first bump array and the second bump array respectively pierce oxidation coatings on surfaces of the feed-in terminal and the grounding terminal, producing contact positive pressure, electrically connecting the feed-in portion and the grounding portion with the feed-in terminal and the grounding terminal.

10 Claims, 6 Drawing Sheets

ANTENNA MODULE FOR MOBILE PHONE

BACKGROUND OF THE INVENTION

1. Field of the Invention

The present invention relates to an antenna module for mobile phone, and particularly to an antenna module for a mobile phone which avoids damage of a connecting interface and ensures stable reception of communication signals.

2. Related Art

With development of communication technology, mobile phones are used very popularly. According to statistics, the number of mobile phones throughout the world has approached 600 million owing to diverse innovations, for example regarding wideband, shapes and multi-function. Antenna modules are ordinarily utilized to receive and radiate electromagnetic waves ranged of various communication frequency bands, contributing to provide mobile phones with worldwide long-distance communication function. Therefore, antenna modules are very important for mobile phones.

A conventional antenna module at least includes an antenna, a feed-in terminal and a grounding terminal. An end of the feed-in terminal and an end of the grounding terminal respectively couple with a main board. Another end of the feed-in terminal couples with a feed-in portion of the antenna, while another end of the grounding terminal couples with a grounding portion of the antenna. Nowadays built-in antennas are mainly of two types: the first one is the stamped copper slice, and the second one is a copper foil made by lithography etching or printing. The first one is not easily to be attached to a curved surface of a shell, and thus gaps between the antenna and the shell tend to make communication signals unstable and produce noise in the case of vibration. The second one is well attached to the curved surface, but tends to be damaged because the connecting interface is comparatively thin. In addition, electrical connection between the feed-in portion and the grounding portion of the antenna and the feed-in terminal and the grounding terminal has the risk of being impacted by fretting, resulting in unstable communication signals and shorten lifespan.

SUMMARY OF THE INVENTION

Accordingly, an object of the present invention is to provide an antenna module for mobile phone, which provides fixed connection between a feed-in portion and a grounding portion of an antenna and a feed-in terminal and a grounding terminal, wherein an adhesive connection substitutes for contacting connection, thereby preventing a filmy interface from scraping; on the other hand, the antenna module for mobile phone is adapted to vibration environment without danger of fretting, thereby assuring stable communication signals reception and communication quality, simplifying structure and manufacturing, reducing cost and lengthening lifespan thereof. Moreover, the feed-in terminal and the grounding terminal are mounted on a side of a shell, and therefore pads on the main board is only required to couple, allowing reduction of area.

Another object of the present invention is to provide an antenna module for mobile phone, which has bump arrays serving as connecting interface, and electrical connection between the antenna and the feed-in/grounding terminal and mechanical connection between the antennal and a shell share common adhesive, thereby simplifying components manufacturing and assembly.

The antenna module for mobile phone of the present invention comprises an antenna, a feed-in terminal and a grounding terminal. The antenna includes an antenna body for receiving and radiating electromagnetic waves, a feed-in portion forming a first bump array, and a grounding portion forming a second bump array. An adhesive is respectively provided on surfaces of the first bump array and the second bump array. The feed-in portion connects with a contact portion of the feed-in terminal by the adhesive, and the grounding portion connects with a contact section of the grounding terminal by the adhesive. In this manner, a contact positive pressure is produced, and the first bump array and the second bump array respectively pierce oxidation coatings on surfaces of the feed-in terminal and the grounding terminal, forming electrical connection of the feed-in portion and the grounding portion with the feed-in terminal and the grounding terminal.

Optimally, the first bump array and the second bump array may be respectively arrayed in form of triangles. At least a corner of triangles of the first bump array forms a first indentation, and at least a corner of triangles of the second bump array forms a second indentation, thereby expelling air/adhesive.

The adhesive is Pressure Sensitive Adhesive. During the adhesive is adhered, adhesiveness and air in a closed region are expelled by smoothening and pressing, thereby forming pressure difference to produce a net pressure on the connecting interface. Net pressure and adhesive force of the adhesive make the closed region act as a small suction disk for retaining electrical connection of the connecting interface.

A protective coating is fixed on the antenna for providing reinforcing force, thereby maintaining stable positive pressure of the first bump array and the second bump array on the connecting interface.

DESCRIPTION OF THE PREFERRED EMBODIMENTS

Figure 1:
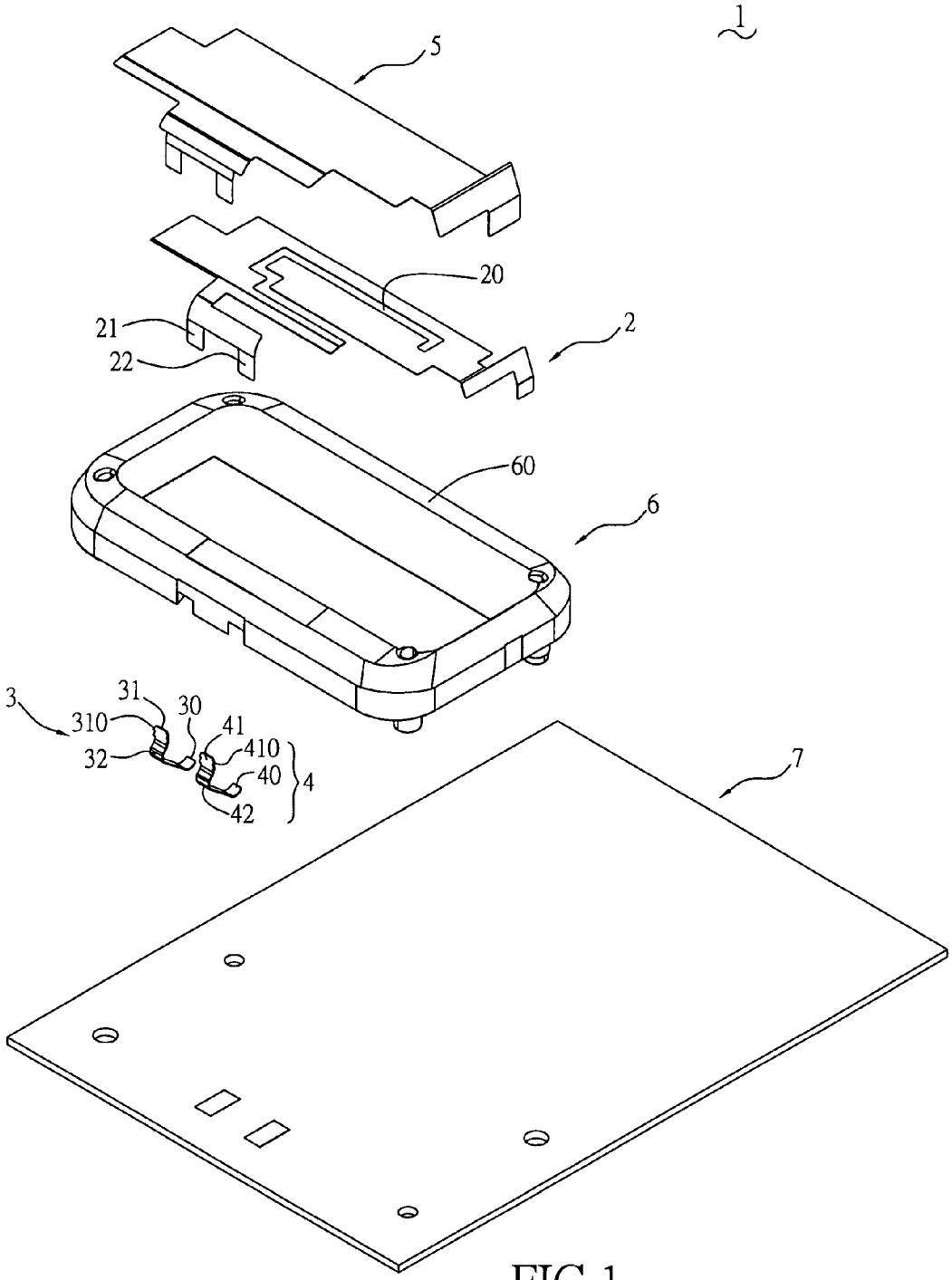
FIG. 1 is an exploded view of an antenna module for mobile phone according to a first embodiment of the present invention.
Figure 2:
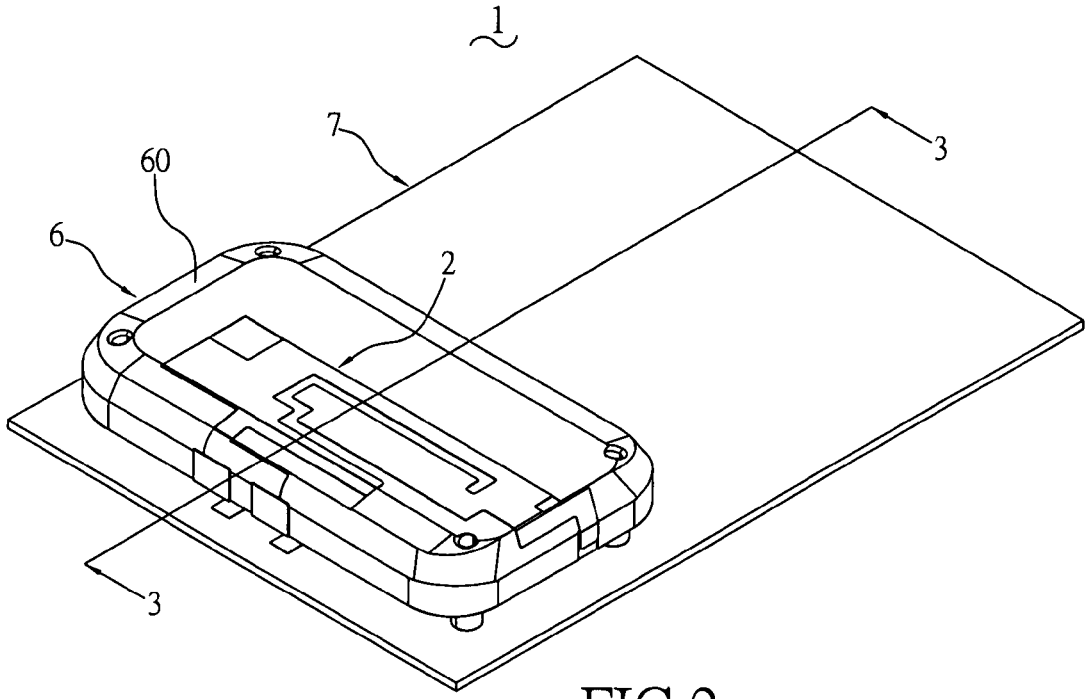
FIG. 2 is an assembled view of the antenna module for mobile phone of FIG. 1.
Figure 4:
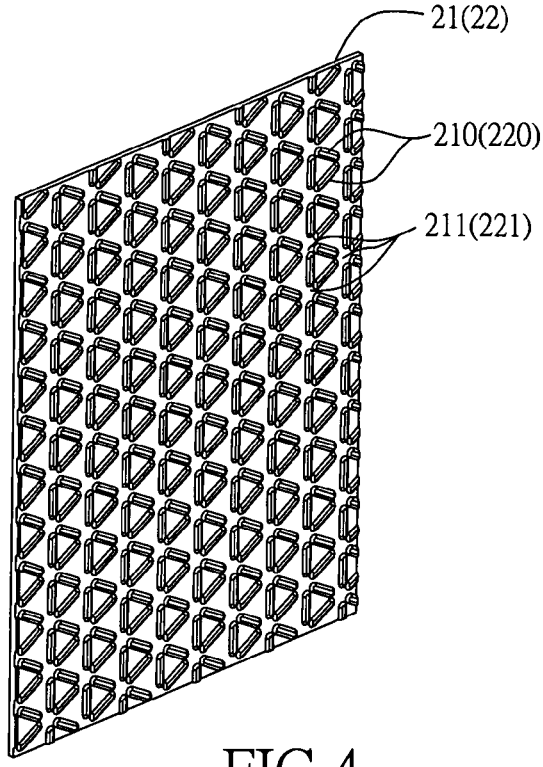
FIG. 4 shows bump array of the antenna module in the form of triangles for mobile phone of the present invention.
Figure 3:
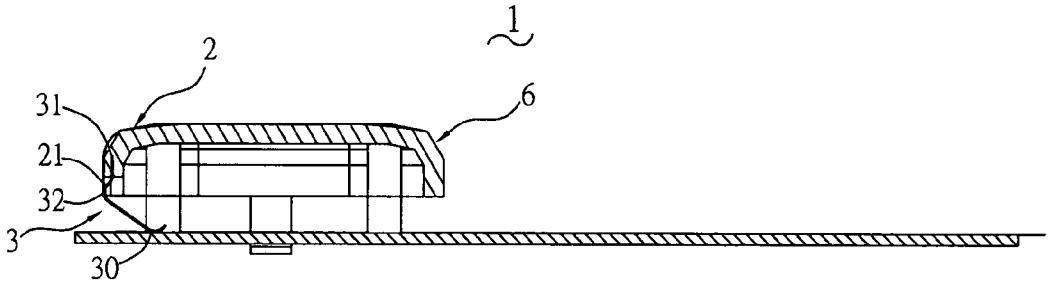
FIG. 3 is a cross-sectional view taken along the line 3-3 in FIG. 2.

Referring to FIGS. 1 to 3, the antenna module for mobile phone 1 is assembled between a mobile phone (not shown) and a main board 7, and comprises an antenna 2, a feed-in terminal 3, a grounding terminal 4 and a protective coating 5. The antenna 2 is a metal foil with particular shape and size, and is assembled on an outer surface 60 of a shell 6 of the mobile phone in this embodiment. The antenna 2 includes an antenna body 20 for receiving and radiating electromagnetic waves, a feed-in portion 21 for contacting the feed-in terminal 3, and a grounding portion 22 for contacting the grounding terminal 4. Combining with FIGS. 4 and 5, a first bump array 210 is formed on the feed-in portion 21, and a second bump array 220 is formed on the grounding portion 22. The first bump array 210 and the second bump array 220 may be formed by means of integrally stamping or printing. Smaller size and reduced interface area may be obtained by means of printing. In this embodiment, the first bump array 210 and the second bump array 220 are shaped by integrally stamping. An adhesive 8 is respectively provided on surfaces of the first bump array 210 and the second bump array 220. The first bump array 210 and the second bump array 220 may be respectively arrayed in form of triangles, and also may be respectively arrayed in form of squares or rounds in practice. The triangle array may perform better suction action. The formula below demonstrates that, the number of suction disks in triangle array is larger than that in square array or round array in the same area, and therefore contact resistance of the triangle array is lower than square array and round array (contact resistance is in inverse proportion of square root of positive pressure). In the formula, Q represents interface quality factor; n represents the number of the working suction disks in a unit of area; $\sqrt{F}$ represents ratio of area to girth of the working suction disks.

$$Q=n\times\sqrt{F}$$

Each triangle of the first bump array 210 forms first indentations 211 at three corners and each triangle of the second bump array 220 forms second indentations 221 at three corners for expelling air/adhesive.

The adhesive 8 is Pressure Sensitive Adhesive. Width of a connecting interface is at least twice of pitches between rows of the first bump array 210/the second bump array 220. Thickness of the connecting interface is proportional to bump height of the first bump array 210/the second bump array 220, as well as spring coefficient of pressed bumps. Thus the adhesive is prevented from being unglued and air is prohibited from entry when bumps are pressed and are inclined to return. During the adhesive 8 is adhered, adhesiveness and air in a closed region is expelled by smoothening and pressing, thereby providing pressure difference to produce net pressure on the connecting interface. The net pressure and the adhesive force of the adhesive 8 makes the closed region act as a small suction disk for retaining electrical connection of the connecting interface.

The protective coating 5 is fixed on the antenna 2 by hot-pressing or adhesiveness for providing reinforcing force thereby maintaining steady positive pressure on the connecting interface.

The feed-in terminal 3 has an end 30 for resiliently contacting the main board 7, and another end 31 forming an interferential portion 310 for being interferentially assembled on the shell 6. A contact portion 32 is protruded from the feed-in terminal 3 and adjacent the interferential portion 310 for contacting the feed-in portion 21.

The grounding terminal 4 has an end 40 for resiliently contacting the main board 7, and another end 41 forming an interferential section 410 for being interferentially assembled on the shell 6. A contact section 42 is protruded from the grounding terminal 4 and adjacent the interferential section 410 for contacting the grounding portion 22.

FIGS. 5A to 5D illustrate the working principle of the bump array. Sum of air pressure F1 (shown in FIG. 5A), adhesive force F2 of the adhesive 8 (shown in FIG. 5B) and reinforcing force of the protective coating 5 (shown in FIG. 5C), substrates returning force F4 of the bumps (shown in FIG. 5D), getting contact positive pressure F5 (not shown). Due to the contact positive pressure F5, the first bump array 210 and the second bump array 220 pierce oxidation coatings on surfaces of the feed-in terminal 3 and the grounding terminal 4, electrically connecting the feed-in portion 21 and the grounding terminal 22 with the feed-in terminal 3 and the grounding terminal 4.

It is appreciated from the above description, the first bump array 210 and the second bump array 220 with the adhesive 8 act as connecting interface, overcoming deficiencies of filmy connecting interface tending to be scraped, eliminating danger of fretting thereby improving connecting interface quality, simplifying components manufacturing and assembly, and decreasing electrical connection area of the main board.

Figure 6B:
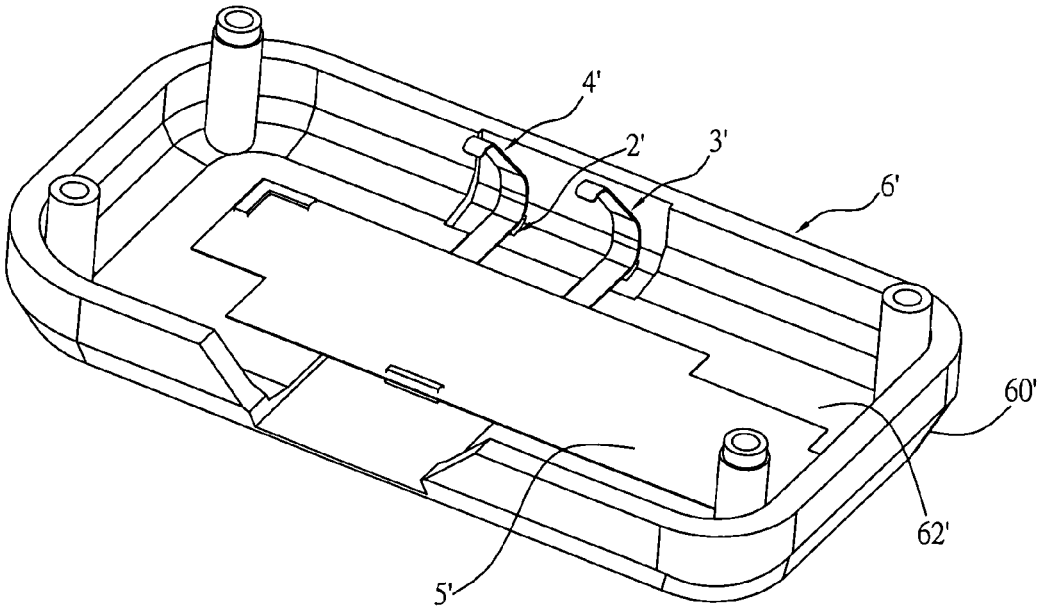
FIG. 6B is an assembled view of the antenna module for mobile phone of FIG. 6A.
Figure 5A:
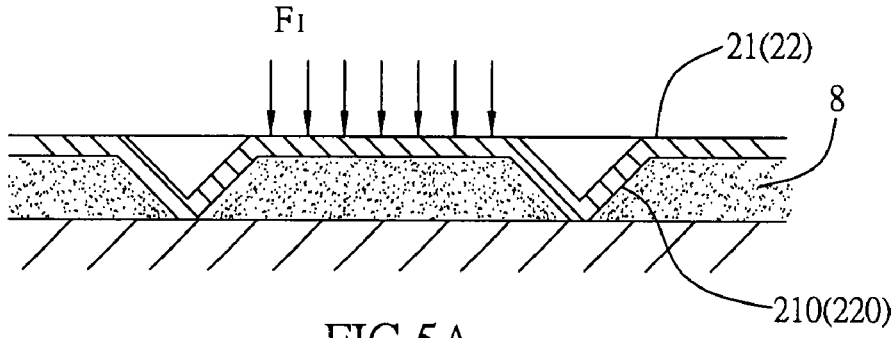
FIGS. 5A-5D illustrate working principle of the bump array.
Figure 5B:
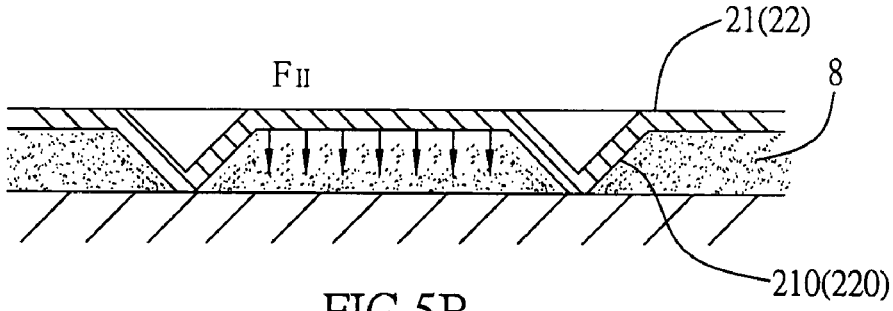
Figure 5C:
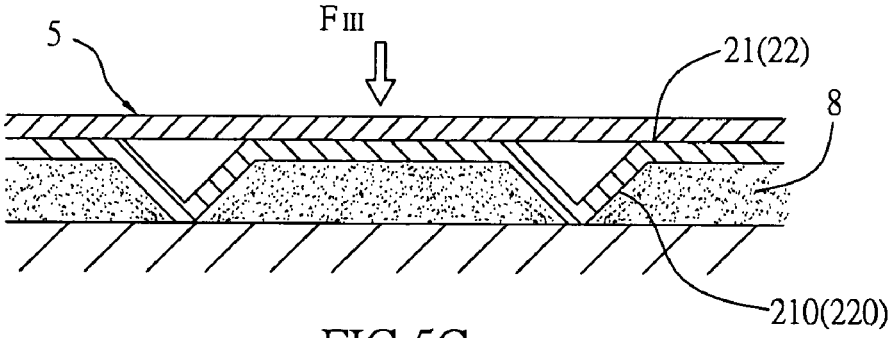
Figure 5D:
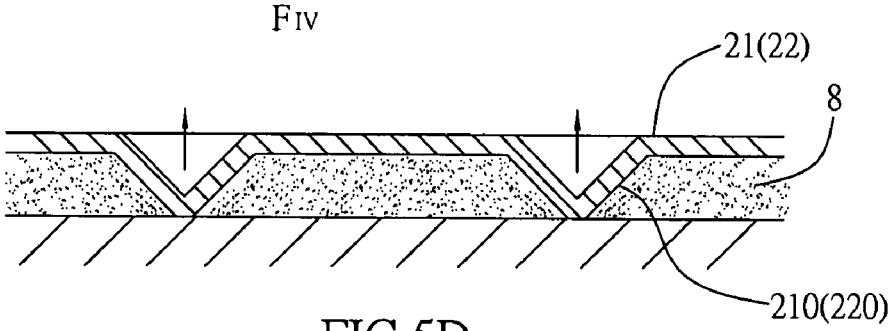
Figure 6A:
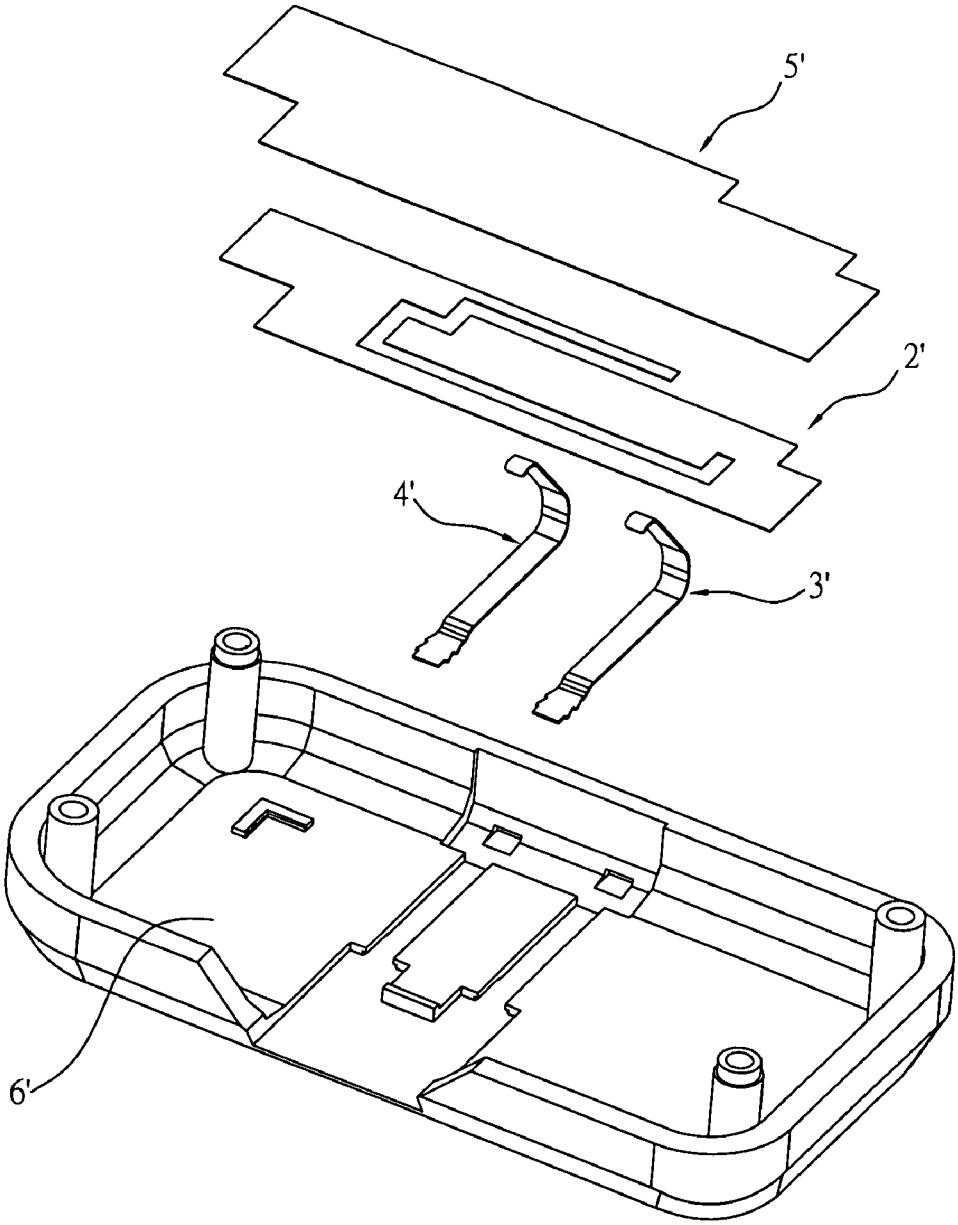
FIG. 6A is an exploded view of an antenna module for mobile phone according to a second embodiment of the present invention.

FIGS. 6A and 6B show an antenna module for mobile phone 1' according to a second embodiment of the present invention. The antenna module for mobile phone 1' is provided on an inner surface 62' of a lower portion 60' of a shell 6' of a mobile phone. A protecting coating 5' provides reinforcing force for maintaining stable positive pressure on connecting interface, thereby electrically communicating a feed-in terminal 3' and a grounding terminal 4' with an antenna 2'.

Figure 7:
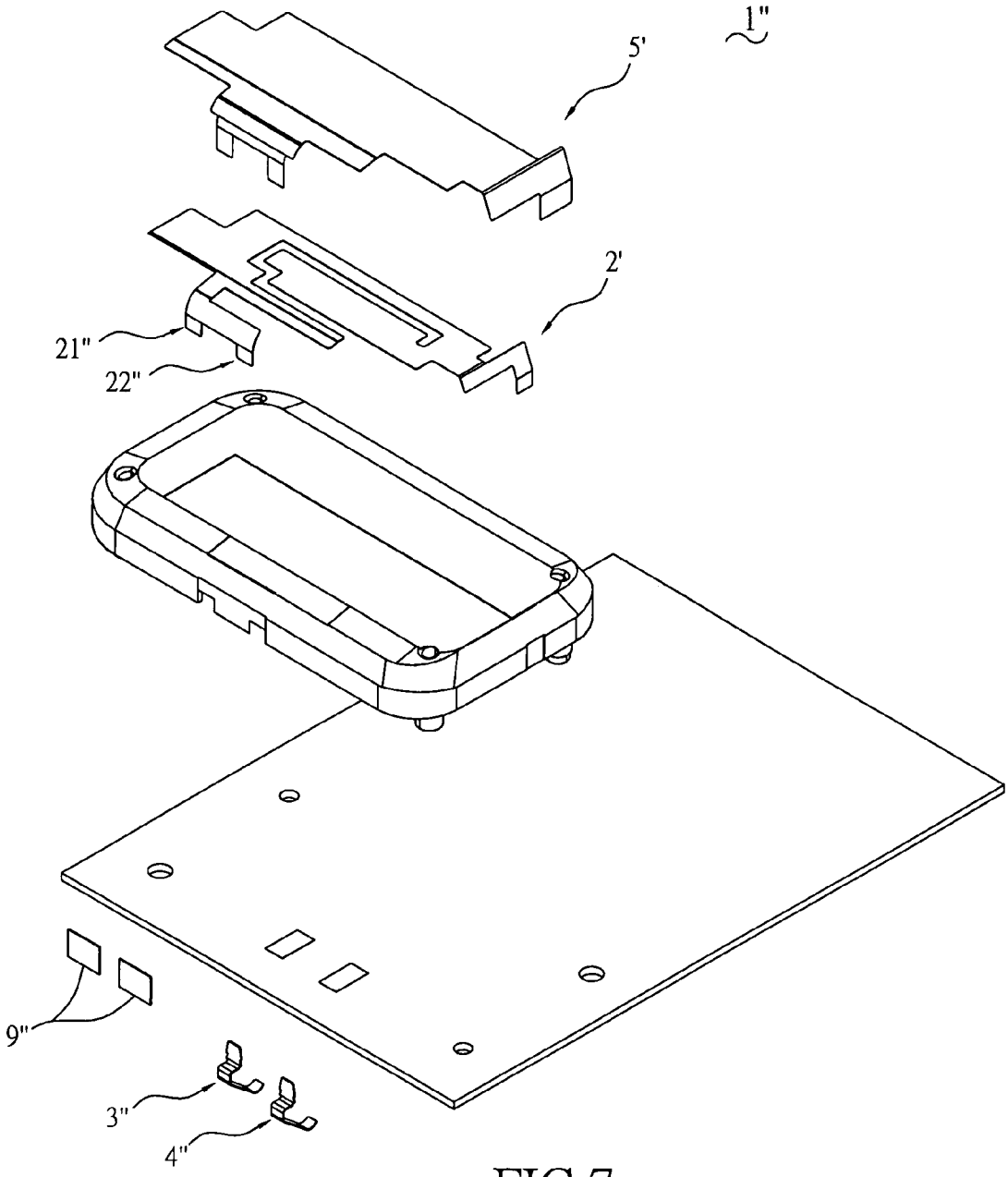
FIG. 7 is an exploded view of an antenna module for mobile phone according to a third embodiment of the present invention.

FIG. 7 shows an antenna module for mobile phone 1" according to a third embodiment of the present invention. The third embodiment is somewhat different from the first embodiment. A feed-in portion 21" and a grounding portion 22" of an antenna 2" electrically connect with a feed-in terminal 3" and a grounding terminal 4" by metal connecting sheets 9". The metal connecting sheets 9" respectively form bump arrays thereon and have an adhesive on surfaces thereof (the adhesive may be Pressure Sensitive Adhesive), which are as the same as the first embodiment and the second embodiment. Similarly, contact positive pressure pierce oxidation coatings on surfaces of the feed-in terminal 3" and the grounding terminal 4", forming electrical connection.

The foregoing is provided for purposes of explaining and disclosing preferred embodiments of the present invention. Modifications and adaptations to the described embodiments may be made without departing from the scope or spirit of the invention.

The invention claimed is:

1. An antenna module of mobile phone, adapted to be assembled between a mobile phone and a main board, comprising:

an antenna being a metal foil assembled on a shell of the mobile phone, and including an antenna body for receiving and radiating electromagnetic waves, a feed-in portion forming a first bump array, and a grounding portion forming a second bump array, and an adhesive being respectively provided on surfaces of the first bump array and the second bump array;

a feed-in terminal having an end assembled on the shell, and another end resiliently contacting the main board, a contact portion being protruded from the feed-in terminal for contacting the feed-in portion; and a grounding terminal having an end assembled on the shell, and another end resiliently contacting the main board, a contact section being protruded from the grounding terminal for contacting the grounding portion;

wherein the first bump array and the adhesive of the feed-in portion connecting with the feed-in terminal, and the second bump array and the adhesive of the grounding portion connecting with the grounding terminal, both producing contact positive pressure so that the first bump array and the second bump array can pierce oxidation coatings on surfaces of the feed-in terminal and the grounding terminal whereby the feed-in portion and the grounding portion electrically connect with the feed-in terminal and the grounding terminal respectively.

2. The antenna module of mobile phone as claimed in claim 1, wherein the first bump array and the second bump array respectively have pitches less than a half of width of connecting interface.

3. The antenna module of mobile phone as claimed in claim 2, wherein thickness of the connecting interface is proportional to bump height of the first bump array and the second bump array and spring coefficient of pressed bumps, so as to prevent unglue of the adhesive and entry of air when bumps are pressed and are inclined to return.

4. The antenna module of mobile phone as claimed in claim 3, wherein the adhesive is Pressure Sensitive Adhesive, and wherein during the adhesive is adhered, adhesiveness and air in a closed region are expelled by smoothening and pressing, thereby forming a pressure difference to produce net pressure on the connecting interface, net pressure and adhesive force of the adhesive making the closed region act as a small suction disk for retaining electrical connection of the connecting interface.

5. The antenna module of mobile phone as claimed in claim 1, wherein the first bump array and the second bump array may be respectively arrayed in form of triangles, and wherein at least a corner of triangles of the first bump array forms a first indentation, and at least a corner of triangles of the second bump array forms a second indentation for expelling air/adhesive.

6. The antenna module of mobile phone as claimed in claim 1, further comprising a protective coating fixed on the antenna for providing reinforcing force thereby maintaining stable positive pressure on the connecting interface.

7. The antenna module of mobile phone as claimed in claim 6, wherein the protective coating is fixed on the antenna by hot-pressing or adhesive.

8. The antenna module of mobile phone as claimed in claim 6, wherein the antenna may be provided on an inner surface of the shell or on an outer surface of the shell.

9. The antenna module of mobile phone as claimed in claim 1, wherein another end of the feed-in terminal forms an interferential portion for being interferentially assembled on the shell, and another end of the grounding terminal forms an interferential section for being interferentially assembled on the shell.

10. The antenna module of mobile phone as claimed in claim 1, wherein the first bump array and the second bump array may be formed by means of integrally stamping or printing.

* * * * *